US006151924A

United States Patent [19]

Plath et al.

[11] Patent Number: 6,151,924

[45] Date of Patent: Nov. 28, 2000

[54] CONTROLLABLE BELT TENSIONER FOR A YARN DELIVERY DEVICE

[75] Inventors: Ernst-Dieter Plath, Albstadt; Stefan Seeger, Jungingen, both of Germany

[73] Assignee: Sipra Patententwicklungs- U. Beteiligungsgesellschaft mbH, Albstadt, Germany

[21] Appl. No.: 09/126,512

[22] Filed: Jul. 30, 1998

[30] Foreign Application Priority Data

Aug. 1, 1997 [DE] Germany ..... 197 33 263

[51] Int. Cl.[7] ..... D04B 15/48; F16H 9/10; F16H 1/08

[52] U.S. Cl. ..... 66/132 T; 474/110; 226/74

[58] Field of Search ..... 66/132 T; 474/110; 226/74, 191, 172

[56] References Cited

U.S. PATENT DOCUMENTS

| | | | |
|---|---|---|---|
| 3,363,815 | 1/1968 | Vostal | 66/132 T |
| 4,854,922 | 8/1989 | Hertrich et al. . | |
| 5,002,519 | 3/1991 | Oshima et al. . | |

FOREIGN PATENT DOCUMENTS

| | | |
|---|---|---|
| 0 256 519 A1 | 2/1988 | European Pat. Off. . |
| 1 143 294 | 2/1964 | Germany . |
| 1 286 680 | 9/1969 | Germany . |
| 2 127 953 | 1/1972 | Germany . |
| 24 36 401 | 3/1975 | Germany . |
| 28 46 279 C2 | 4/1982 | Germany . |
| 39 31 997 A1 | 4/1991 | Germany . |
| 1 462 335 | 1/1977 | United Kingdom . |
| 2 084 689 | 4/1982 | United Kingdom . |
| WO 96/09238 | 3/1966 | WIPO . |
| 91/10847 | 7/1991 | WIPO . |

*Primary Examiner*—Andy Falik
*Attorney, Agent, or Firm*—Michael J. Striker

[57] ABSTRACT

A yarn delivery device for a textile machine has at least one yarn delivery roller, and a drive device for a propulsion of the delivery roller, the drive device including a drive belt, a drive roller with a peripheral section alterable in diameter and at least in part in part looped around by the drive belt, and a tensioning unit with a guide member acting on the drive belt, the tensioning unit including a controller for producing at least one larger belt tension for normal operation of the delivery roller and a smaller belt tension for alteration of the diameter of the peripheral section of the drive roller.

17 Claims, 6 Drawing Sheets

CONTROLLABLE BELT TENSIONER FOR A YARN DELIVERY DEVICE

BACKGROUND OF THE INVENTION

The invention relates to a yarn delivery device with at least one yarn delivery roller on a textile machine comprising a drive device intended for the propulsion of the delivery roller and having a drive belt, a drive roller with a peripheral section alterable in diameter and at least in part looped around by the drive belt, and a tensioning device with a guide member acting on the drive belt and to a belt tensioning device intended for operation of the yarn delivery device.

Known yarn delivery devices of this type (DE-PS 1 286 680, de 39 31 997 A1) have a plurality of yarn delivery devices, associated with individual systems of a circular knitting machine, with delivery rollers delivering yarns, and which are rotated by a common drive belt. The drive belt is frequently propelled by a drive roller, which has a variable-diameter peripheral section at least partly looped about by the drive belt, in order to enable setting at identical rotational speed of the drive roller, different yarn delivery speeds or different delivered quantities of yarn which vary via the selection of diameter. The alteration in diameter of the drive roller can be effected manually or automatically.

Associated with the drive belt of such yarn delivery devices is an automatically operating tensioning device, which on the one hand enables enlargements in the diameter of the drive roller and on the other hand keeps the drive belt automatically tensioned during reductions in diameter, in order to avoid slippage. The tension device usually contains a tension roller, at least partly looped about by the drive belt, and which is under the influence of a force, particularly a resilient force.

A problem arising during diameter alteration of the drive roller resides in the fact that due to the tension obtaining in the drive belt comparatively large frictional forces have to be overcome, particularly when the alteration is to be effected in the direction of enlarging diameter over a large displacement path. Therefore during a manual shift of the diameter carried out when the textile machine is stopped, the tension device is frequently firstly manually so adjusted that the drive belt hangs down loosely. Such an adjustment is basically in fact possible, but is always difficult to execute if the belt tensioning device is not easily accessible, as is the case for example for circular knitting machines in which the yarn delivery device and with it the drive belt are frequently located high above the floor and are not simply accessible by the service personnel. If on the other hand alteration in the diameter of the drive roller is carried out automatically with the textile machine running, then this may only be carried out in that the alteration in diameter is undertaken only as slowly as the frictional conditions permit, which is not always acceptable.

SUMMARY OF THE INVENTION

It is, therefore, an object of the present invention to design the yarn delivery device described above in such a way that it permits a user-friendly alteration in diameter of the drive roller.

A further object of this invention is to design the yarn delivery device such that the alteration in diameter of the drive roller can be executed from a control panel without the necessity for complex manipulations at parts of the textile machine which are difficult to access.

A further object is to design the yarn delivery device such that the alteration in diameter of the drive roller is possible irrespective of whether the diameter alteration is to be carried out with the textile machine running or stopped.

Yet another object of the present invention is to design the tension device such that different belt tension can be provided for normal operation and for alteration of the diameter of the drive roller.

And yet another object of the present invention is to provide a belt tensioning device suitable for the desired purpose mentioned above.

These and other objects of the invention are solved by means of a yarn delivery device of the type above specified wherein in accordance with this invention the tension device includes controllable means for producing at least one larger belt tension intended for normal operation of the delivery roller and a smaller belt tension intended for alteration of the diameter of the peripheral section of the drive roller.

BRIEF DESCRIPTION OF THE DRAWINGS

The invention will be described in more detail in the following in conjunction with the annexed drawing and with reference to an embodiment of a circular knitting machine given by way of example. Shown are.

DESCRIPTION OF PREFERRED EMBODIMENTS

Figure 1:
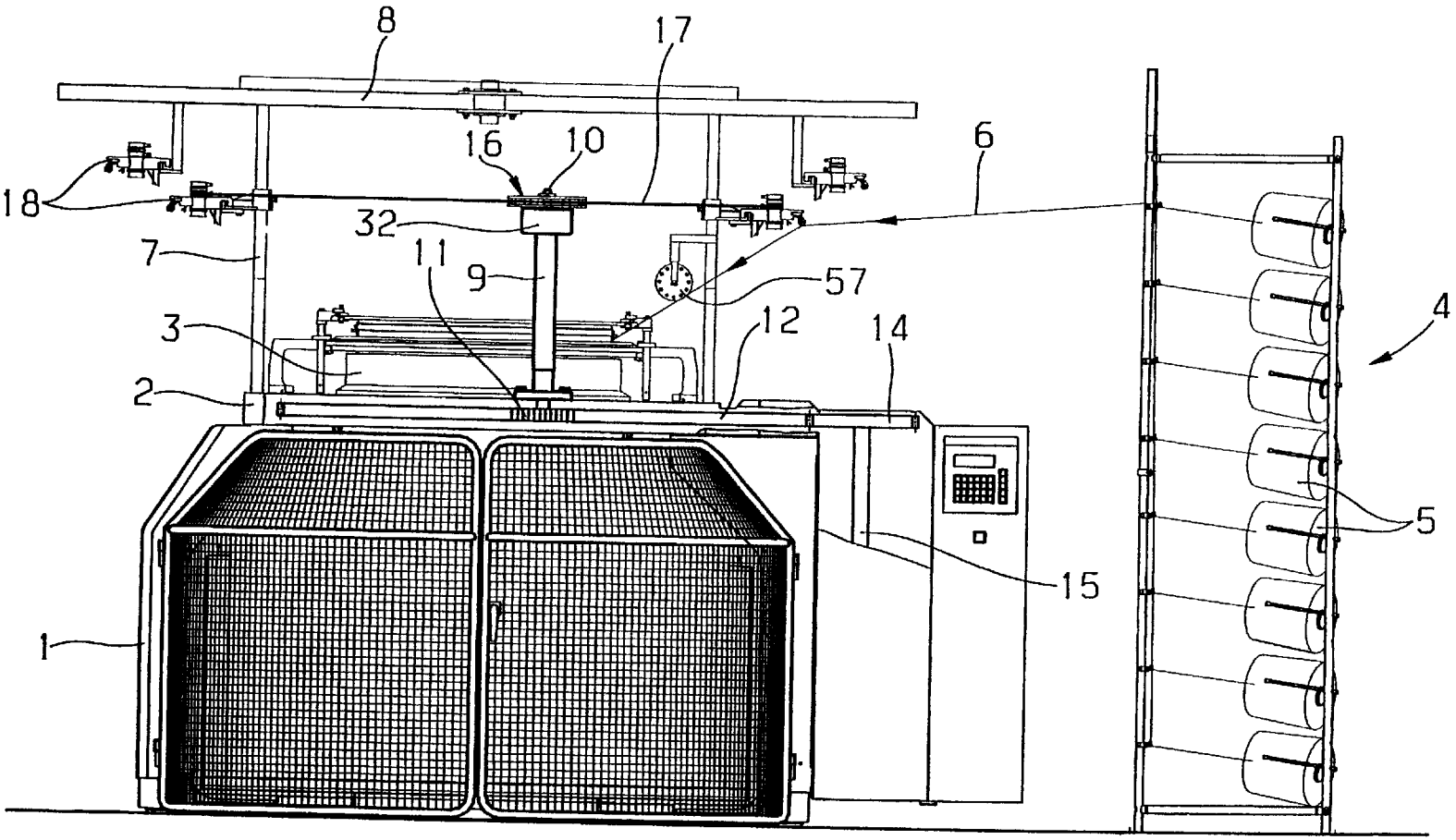
FIG. 1: a partially broken-away front view of the portions of a circular knitting machine essential for the invention, with a yarn delivery device.

The circular knitting machine according to FIG. 1 has a framework 1 with a base plate 2 and a needle cylinder 3 rotatably mounted thereon. Next to the framework 1 is mounted a creel 4 for thread bobbins 5, from which yarns 6 are withdrawn and passed in the direction of the arrow to the knitting needles mounted in the needle cylinder 3.

Supported on the framework by means of carriers 7 and/or by a support ring 8 carried thereby, is a yarn delivery device. The latter includes a tubular carrier section 9 secured on the base plate 2, and in which there is rotatably mounted a shaft 10, which projects with both ends out of the tubular carrier section 9. Secured to the lower end in FIG. 1 of the shaft 10 is a gearwheel 11, which is connected in a drive relationship via a gearwheel 12 to a gearwheel 14, which sits on a drive shaft 15, which is mounted in a way not shown in further detail in the circular knitting machine and is propelled at a pre-selected transmission ratio and synchronously with the needle cylinder 3. In addition the yarn delivery device includes a drive roller 16 (FIGS. 2 and 3), secured to the other end of the shaft 10, and with a peripheral section 16*a*, upon which there is applied along a pre-selected loop angle an endless drive belt 17, which in addition is applied at least partly on the circumference of at least one, but as a rule a plurality of driven yarn delivery rollers 18, which are rotatably mounted on the carriers 7 or in the carrier ring 8. Associated with these as a rule positively, i.e. slip-free driven delivery rollers 18, correspondingly positively delivering the yarn 6, there are yarn eyes not shown in more detail, which for example serve in a way known per se to guide the yarns 6 in such a way that they come respectively to lie between the circumference of a respective associated delivery roller 18 and the drive belt 17 and are thus automatically guided in the direction of the arrow. Naturally, all other types of positive yarn delivery can be provided.

Yarn delivery devices of this type, and their function, are generally known (DE-PS 1 143 294 or DE 39 31 997 A1) and therefore need no further explanation.

Figure 2:
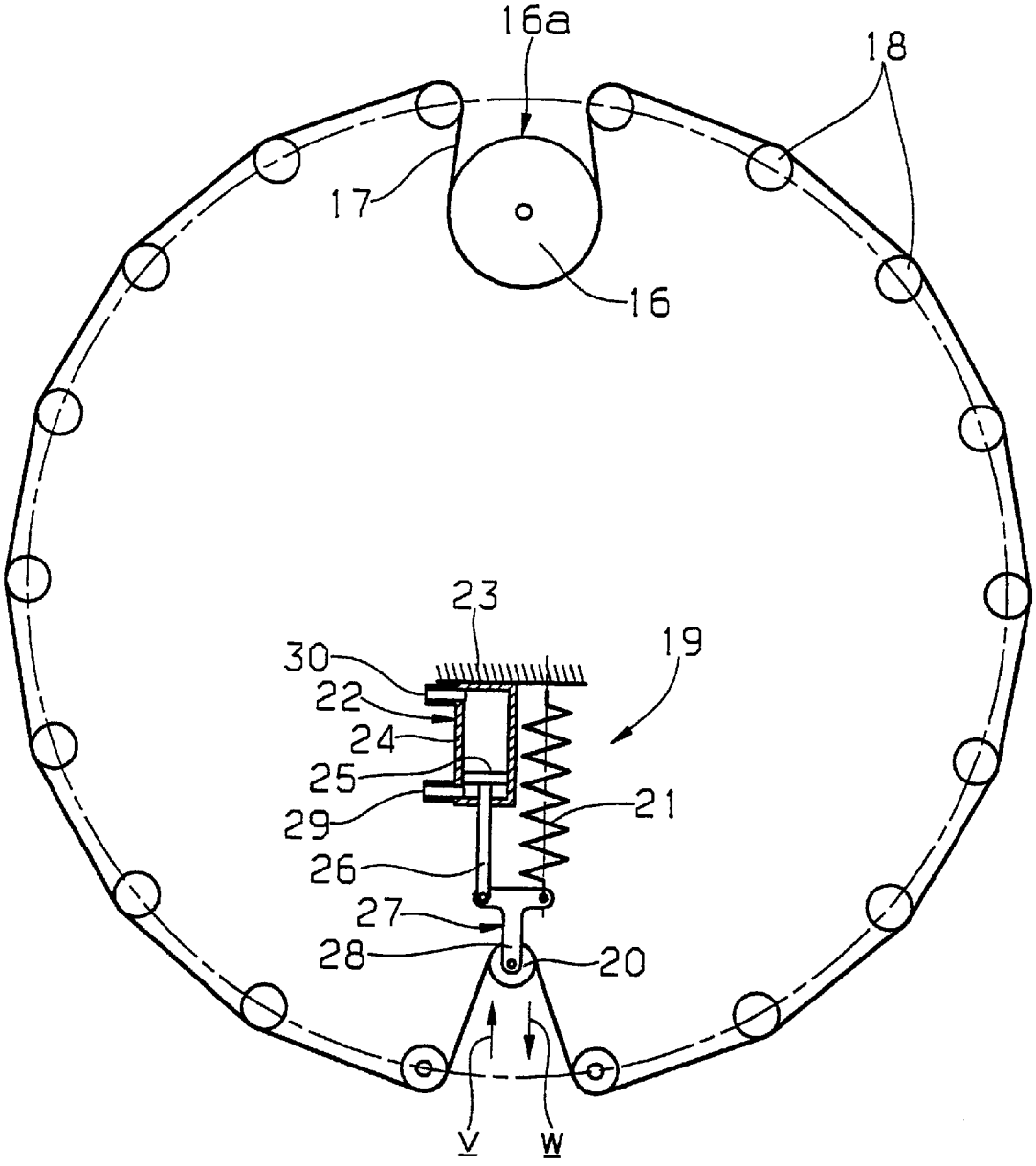
FIGS. 2 and 3: respective schematic plan views, on an enlarged scale compared to FIG. 1, of a yarn delivery device comprising a belt tensioning device according to the invention and being shown in two different operating positions.
Figure 3:
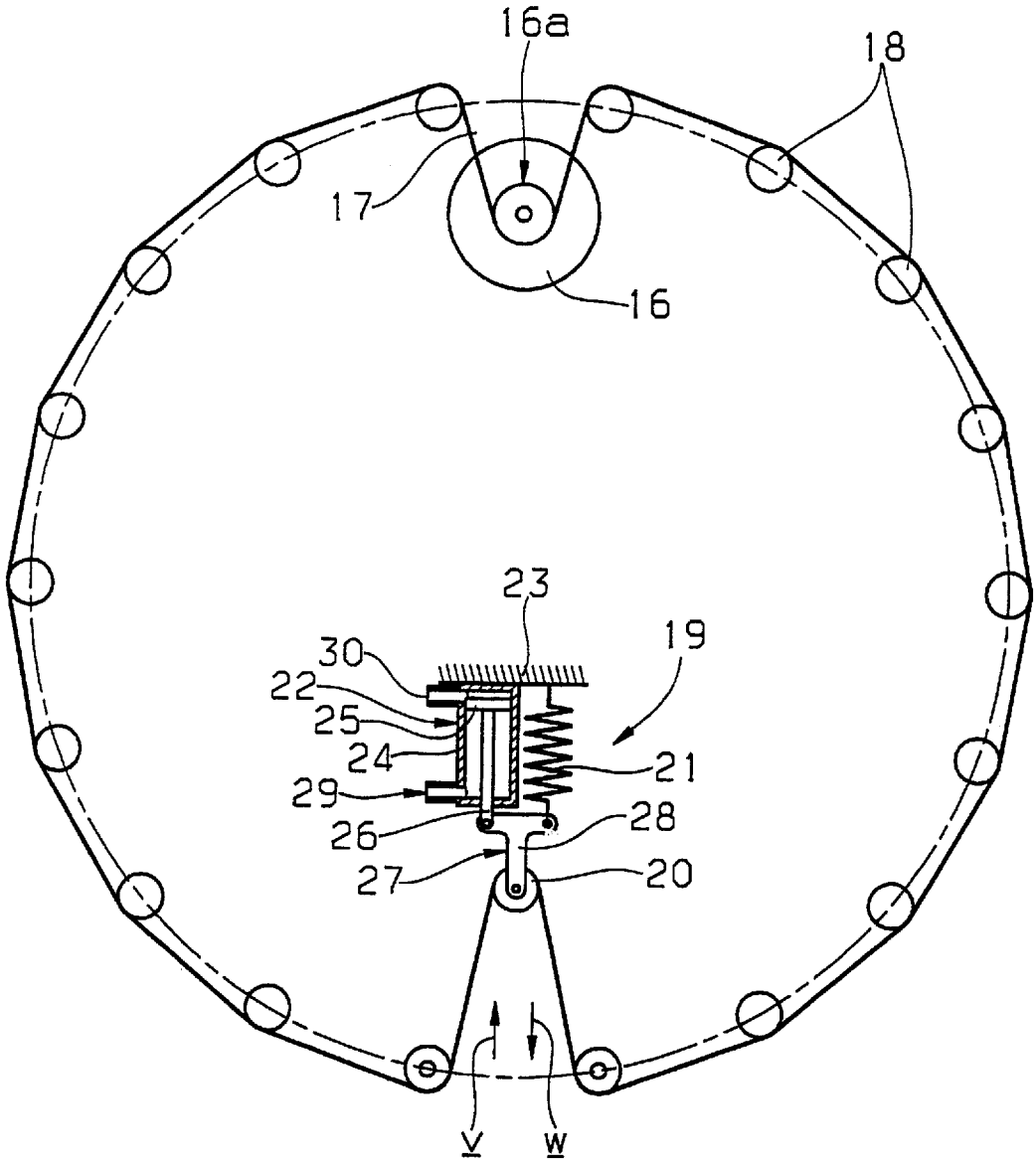

As FIGS. 2 and 3 further show, the drive belt 17 running over the drive roller 16 can be kept under tension by means of a preferably automatically operating tensioning device 19, which for example contains a movably mounted guide member 20 for the drive belt 17, here for example a guide roller at least partly looped around by the drive belt 17, and which is under the influence of a force, particularly under the force of a tension spring 21 engaging thereon or a weight acting thereon, so that upon an alteration in diameter of the drive roller 16, the drive belt 17 is automatically compensated.

In order to alter the effective diameter of the peripheral section 16*a* of the drive roller 16 about which the drive belt 17 loops, said drive roller 16 has for example two preferably plane-parallel discs, of which one is non-rotatably connected, e.g. by means of a feather key or the like, to the shaft 10 (FIG. 1). The other disc located at a spacing from and co-axial with the first, is mounted to rotate relative to the first disc. The first disc has on its lower surface facing the second disc grooves extending radially to the shaft 10, whereas the second disc has on its upper side associated with the first disc at least one spirally extending groove. Slide pieces are located between both discs, which form the circumference or the peripheral surface of the drive roller 16 and serve for contact with the drive belt 17. Thus the effective diameter of the circumference of the drive roller 16 can be altered in that the slide pieces mounted in the grooves with pins, projections or the like are displaced radially outwards or inwards by relative rotation of the two discs with respect to one another.

Drive rollers 16 of this type, which are frequently termed regulating discs, and their function, are likewise generally known (DE-PS 1 286 680 and 28 46 279) and therefore require no further explanation. In order to avoid repetition, the two last-named publications and DE-PS 1 143 294 and DE 39 31 997 A1 are incorporated into the subject-matter of the present disclosure by making reference thereto.

FIGS. 2 and 3 show the drive roller 16 and the drive belt 17 in two different operating positions. FIG. 1 shows the peripheral section 16*a* of the drive roller 16 at its largest diameter, and on the other hand in FIG. 3 adjusted to its smallest diameter. Therefore, as a comparison of FIGS. 2 and 3 shows, the tensioning spring 21 in FIG. 2 is less intensively compressed than in FIG. 3, and the guide member 20 in FIG. 2 is displaced inwardly radially to a smaller distance than in FIG. 3, so that the drive belt 17, despite the different diameter of the drive roller 16, is kept substantially at the same tension and is held without slip in contact with the various rollers and delivery rollers.

If the diameter of the drive roller 16 is to be altered, it is normally necessary for this purpose to relax the drive belt 17 by rendering the guide member 20 or the tension spring 21 inoperative. For this purpose for example the guide member 20 is manually displaced or the drive belt 17 is de-coupled therefrom in another way. According to the invention however means are provided by means of which this relaxation can be to a large extent undertaken automatically.

According to FIGS. 2 and 3 these means include a controllable or switchable actuator in the form of a tensioning unit 22, connected to the guide member 20, and which in the embodiment consists of a pneumatic or hydraulic cylinder/piston arrangement, which is secured by one end to a rigid portion 23 of the machine frame or the like, and a cylinder 24, a piston 25 reciprocating therein and a piston rod 26 secured thereon, the end of which, projecting out of the cylinder 24, is connected to the guide member 20. For this purpose the piston rod 26 is articulated for example to a fork-shaped holder 27 with two arms 28. which have bearing bores in which the ends of the guide member 20, in the form of a guide roller, are rotatably mounted. The cylinder 24 is provided at both ends with a respective connection opening 29,30 for a hydraulic or pneumatic pressure medium, e.g. oil or air, by means of which the tensioning unit 22 can be so controlled that the piston rod 26 either adopts its fully extended position (FIG. 2), or is pre-tensioned in the direction of its fully retracted position (FIG. 3). Thus the tensioning unit 22 is preferably present in addition to the tension spring 21, which is appropriately located parallel to the tensioning unit 22, attached by one end to the holder 27, and secured by its other end like the cylinder 24, on part 23.

Figure 4:
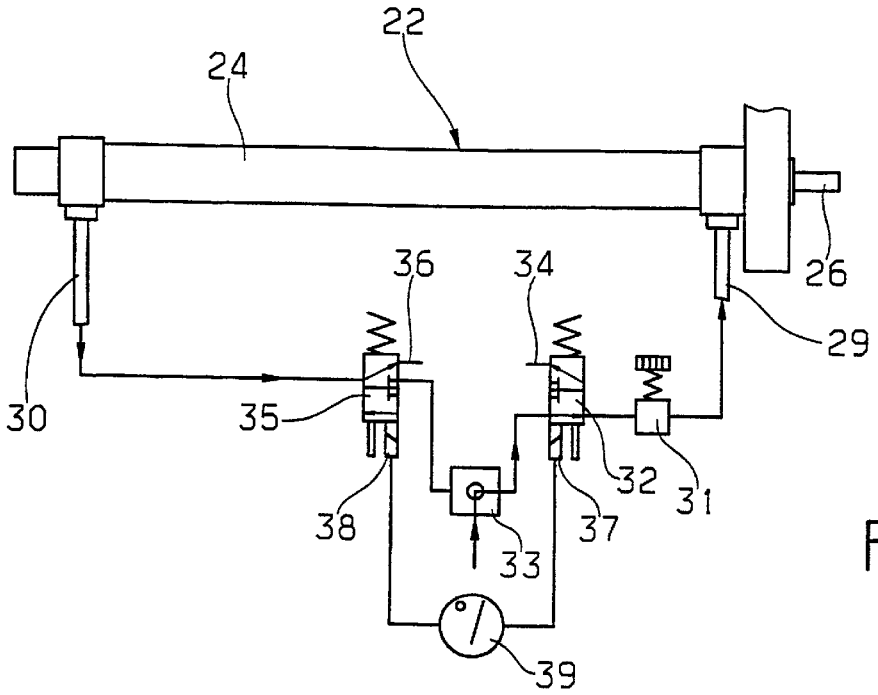
FIGS. 4 and 5: a circuit arrangement for operating the belt tensioning device according to FIGS. 2 and 3, in two different operating positions.
Figure 5:
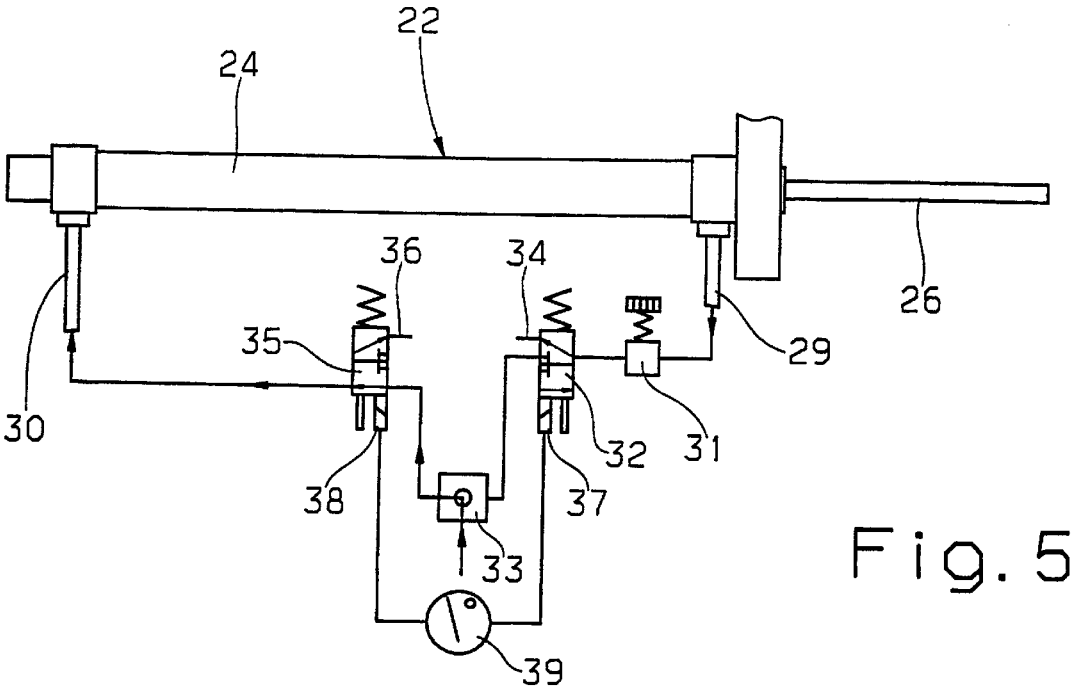

FIGS. 4 and 5 show a simple switching arrangement for actuating the piston 25 of the tensioning device according to FIGS. 2 and 3, identical parts being provided with the same reference numbers. The connection opening 29 communicates via a pressure regulating valve 31 with one outlet of a 3/2 way valve 32, which has an input connected to a pressure source 33 and a further connection linked to a schematically illustrated evacuation line 34. On the other hand the connection opening 30 is connected to one output of a second 3/2 way valve 35, which has an input connected to the pressure source 33 and a further connection linked to a schematically illustrated evacuation line 36. Both valves 32,35 are controllable by switchable electro magnets 37,38, which can be optionally energised or deactivated by means of an electrical switch 39.

In a preferred embodiment of the invention, the tension force of the tension spring 21 is so selected that when the tensioning unit 22 is inoperative, said tension spring maintains a pre-selected minimum tension in the drive belt 17. This minimum tension is so established that on the one hand, when this belt tension is present, the drive roller can be relatively easily adjusted irrespective of whether the diameter of its peripheral section 16*a* is to be enlarged or reduced, without excessive frictional forces arising due to the tension in the drive belt 17, while on the other hand however the belt tension is still sufficient to keep the drive belt 17 in operation, without it for example slipping off one of the various rollers or tensioning members.

The method of operation of the tensioning device 19 according to FIGS. 2 and 5 is as follows:

During normal operation of the circular knitting machine there is passed to the cylinder 24 via the connection opening 29 a pressurised medium coming from the pressure source 33, while according to FIG. 4 the magnet 37 is energised by means of the switch 39. Simultaneously the magnet 38 is de-energized and the valve 35 is held by means of a spring or the like in a position in which the connection opening 30 is connected to the evacuation line 36. The connection opening 30 is therefore open so that any medium present on the associated side of the piston can flow out. In the embodiment the arrangement is thus such that the piston rod 26 is drawn into the cylinder 24 and thereby the guide member 20 is drawn radially inwards in the direction of an arrow v (FIG. 3). Thus the drive belt running over the guide member 20 is tensioned, the tension force being substantially dependent on the pressure at which the pressure medium is compressed through the connection opening 29 into the cylinder 24, this pressure being adjustable by means of the pressure regulating valve 31 which has an adjusting knob. Moreover, the piston 25 is moved in the direction of the arrow v until the counter-force exerted by the drive belt 17 is of equal magnitude and an equilibrium is established in accordance with a pre-selected tension in the drive belt 17. This greater belt tension present during normal operation is to a large extent independent of the diameter at any time of the drive roller 16 and is made up of a portion determined by the tension force of the piston rod 26 and a portion determined by the tension force of the tension spring 21. As the tension spring 21 however is only intended to ensure a minimum belt tension, the greater tension force in normal operation is established substantially by the switchable tensioning unit 22.

If an alteration in the diameter of the peripheral section 16*a* of the drive roller 16 is to be undertaken, the magnet 38 is energised and magnet 37 is de-energized by means of the switch 39 (FIG. 5), in order to connect the pressure source 33 through the valve 35 with the connection opening 30, the valve 32 simultaneously being returned by a spring or the like into a position in which the connection opening 29 is connected to the evacuation line 34. Consequently the piston rod 26 is extended out of the cylinder 24 (FIG. 2) and the drive belt is relaxed. Alternatively it would also be possible in this process step to connect only the connection opening 29 to the evacuation line 34 and to allow the pressure medium to flow un-pressurised through the connection opening 30 on the other side of the piston. In this case the drive belt 17 is relaxed due to its own intrinsic substantially elastic tension force, and thus the guide member 20 is carried in a direction (arrow w) opposite to arrow v, and in turn draws the piston rod 26 further out of the cylinder 24 and tensions the tension spring 21. For this case also an equilibrium condition is established which is characterised by a smaller belt tension substantially established by the tension spring 21 and intended for alteration in the diameter of the drive roller 16, this belt tension being selected preferably smaller than that which would correspond with the fully extended position of the piston rod 26.

The diameter of the peripheral section 16*a* of the drive roller 16 can now be adjusted at will. Thereafter the connection opening 29 of the cylinder 24 is again supplied with pressure medium, so that the belt tension automatically again adopts the pre-selected larger value.

Thus the described tensioning device enables two different belt tensions to be simply set, in that the cylinder 24 is either provided with compressed air or is evacuated, i.e. is switched on or off. Irrespective of where the tensioning device 19 is located on the circular knitting machine, by means of a simple switching procedure by means of a switch 39, executed for example from an operator's control panel, it can be ensured that the subsequent alteration in diameter of the drive roller 16 can be undertaken with low friction and using a setting device known per se (e.g. DE 39 31 997 A1), and likewise to a large extent automatically.

With the embodiment according to FIGS. 2 and 3 it is possible to adjust even further belt tensions instead of the two belt tensions predetermined by the tensioning spring 21 and a tensioning unit 22. This is for example possible in that an alteration in the pressure at which the pressure medium is passed into the cylinder 24 is undertaken. Another possibility is that further identical or similar tensioning units are incorporated in parallel with the tensioning unit 22, and the pressures of the pressure medium fed to these units can be set to differing constant values. In this way, for example for an enlargement in the diameter of the drive roller 16, a smaller belt tension could be pre-selected for example than for a reduction in diameter.

The tension spring 21 is preferably a gas pressure spring. In this way an equally large spring force can be effected in a simple way over the entire length of the displacement path.

Figure 6:
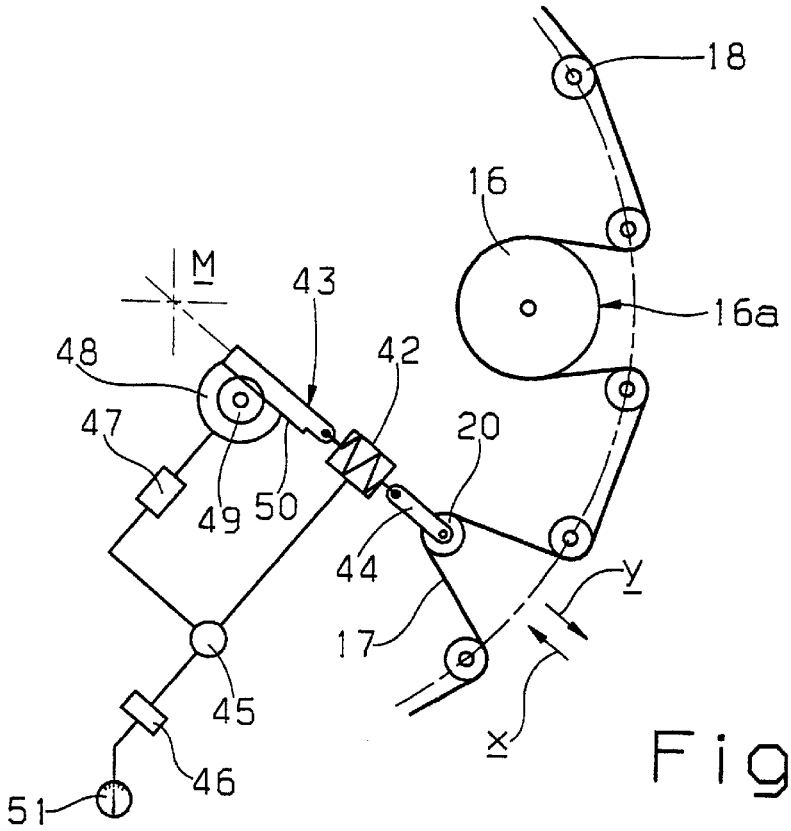
FIGS. 6 and 7: partial views corresponding to FIGS. 2 and 3 of a second embodiment of the belt tensioning device according to the invention, likewise shown in two different operating positions.
Figure 7:
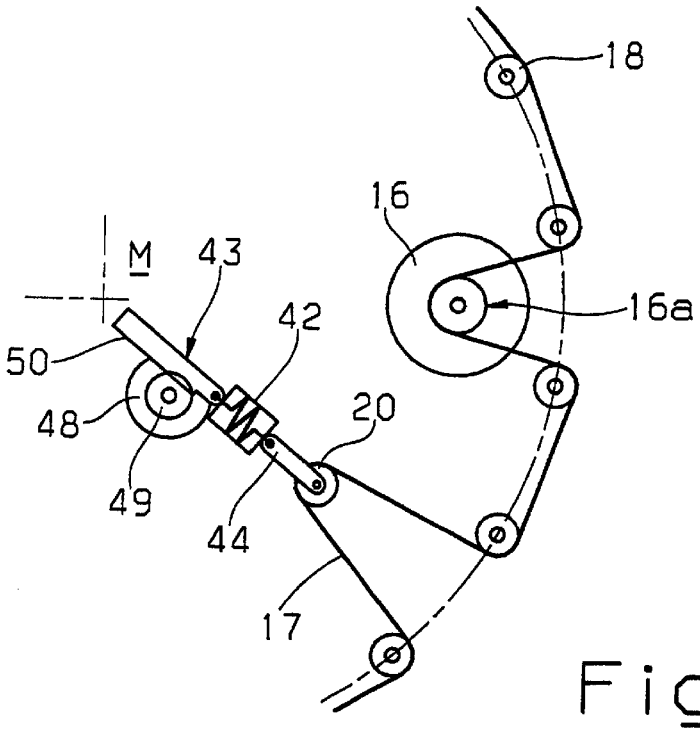

FIGS. 6 and 7 show an embodiment in which the belt tension is adjusted with the aid of a regulating device shown only schematically in FIG. 6. For reasons of simplicity, here only a portion of the circumferential circle is shown with the centre point M upon which circle the totality of the delivery rollers 18 is located in FIGS. 2 and 3, and the guide element 20 is located in the direct vicinity of the drive rollers 16. Otherwise identical parts are provided with the same reference numbers.

Here the guide member 20 is connected by a schematically shown power measuring device 42 to a controllable or switchable actuator in the form of a tensioning unit 43, and can be pushed to-and-fro therefrom similarly to FIGS. 2 and 3 radially to the centre point M, in order to tension the drive belt 17 to a greater or lesser extent. The measuring device 42 is located between the tensioning unit 43 and a holder 44 for the guide member 20, and is for example in the form of an intermediate spring, so that inaccuracies in the movement of the tensioning unit 43 do not become immediately noticeable as large tension alterations in the drive belt 17. The fluctuations of this intermediate spring are converted e.g. into an electrical actual-value signal characteristic for the belt tension at any moment, said signal being passed to one input of a comparator 45, which has a second input, which is connected to a required-value (nominal-value) emitter 46, which emits a required-value signal in accordance with a pre-selected belt tension. The comparator 45 compares the required and actual signals and passes a differential signal determined from both to a regulator 47, which is connected to an adjusting device 48 acting on the tensioning unit 43. The components 20 and 42 to 50 thus form a regulating device by means of which the belt tension is automatically kept at the nominal value predetermined by the required-value emitter 46.

In the embodiment the regulating device is constructed as an electrical or electronic regulating device, i.e. the actual and required-value signals are electrical signals. The setting device 48 for example consists of an electric motor, particularly a servo or stepping motor, upon the output shaft of which there is secured a spur pinion 49, while the tensioning unit 43 is provided for example on one longitudinal side with a rack 50 meshing with the spur pinion 49. Depending on the direction of rotation of the electrical motor, the tensioning unit 43 is moved either under the tension of the drive belt 17 in the direction of an arrow x or under the relaxation of the drive belt 17 in the direction of an arrow y.

The required-value signal given off by the required-value emitter 46 can be pre-selected in stages or infinitely variably for example with the aid of an electrical rotary switch 51 shown schematically in FIG. 6 and connected to the required-value emitter 46. In this way it is possible, as in the case of FIGS. 2 and 3, to produce at least two different belt tensions serving for normal operation or diameter alteration of the drive roller 16, which are additionally monitored and regulated to constant values in the embodiment according to FIGS. 6 and 7 by the regulating device.

Other measuring devices can be provided instead of the power measurement device 42 indicated in FIGS. 6 and 7. Reference is made only by way of example to all those measuring devices which are generally used in knitting machines e.g. for measuring the yarn tension, and can be analogously used here for the drive belt 17. Such measuring devices have for example a pivot lever located between two delivery rollers 18, which is provided with a guide member abutting on the drive belt 17, and which holds the pivot lever in a pivoted position dependent on the belt tension. The position of the pivot lever is scanned for example by opto-electronic means and then provides an electrical actual-value signal characteristic for the belt tension. Such a measuring device is explained for example in EP 0 256 519 A1, which is hereby incorporated into the subject-matter of the present disclosure by making reference thereto in order to avoid repetition.

Figure 8:
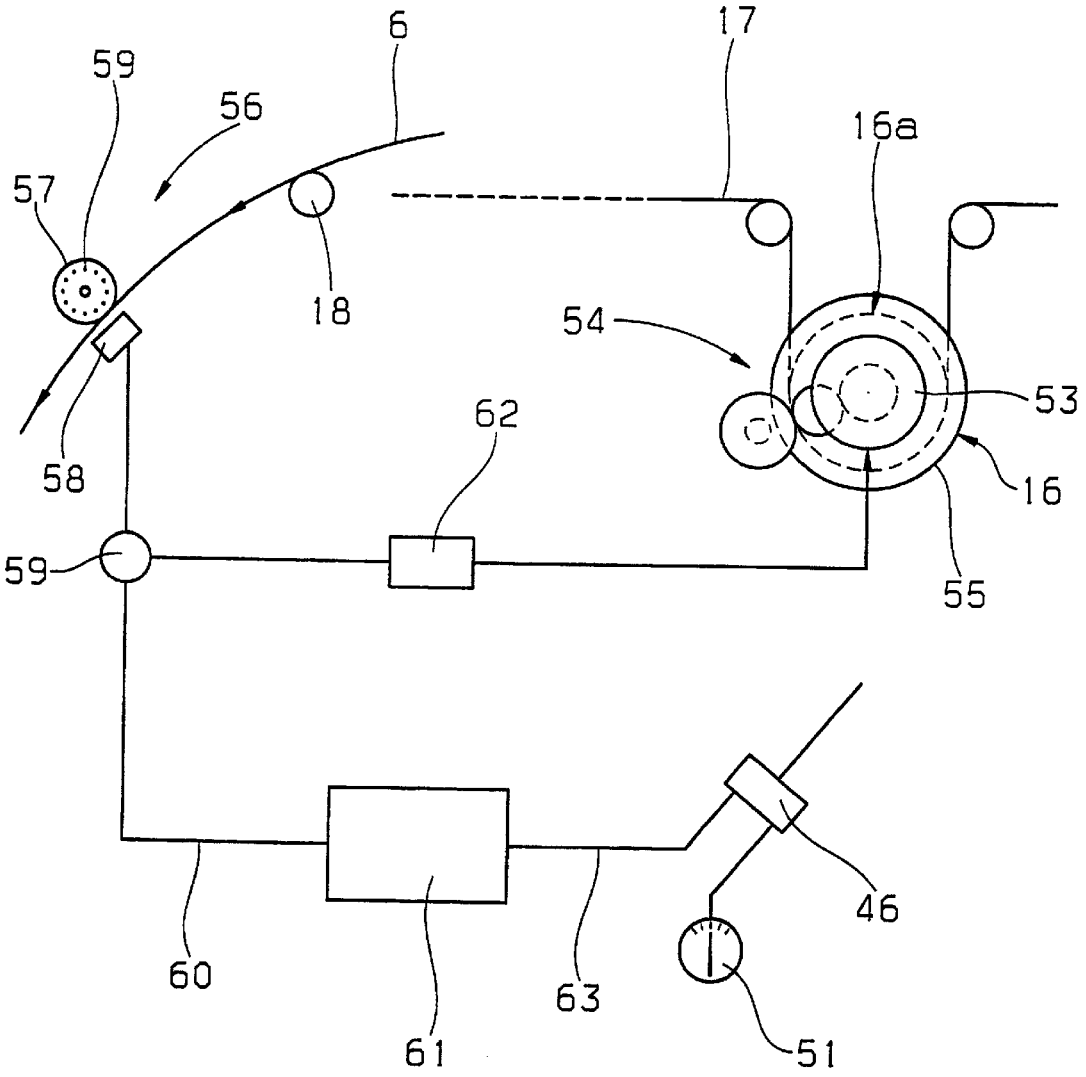
FIG. 8: a schematic block diagram of the belt tensioning device according to the invention as a portion of a program control device intended for automatic diameter alteration of a drive roller of the yarn delivery device.

If adjustment of the diameter of the drive roller 16 is to be effected automatically instead of manually as described above, the required-value emitter 46 is for example applied to the output of a program control device conventionally present in textile machines, or is switched over thereto. In this case for example the program control device on the one hand gives out control signals which are passed to the adjusting device (e.g. DE 39 31 997 A1) set up for diameter alteration of the drive roller 16, and on the other hand pass required-value signals in good time before and after the alteration in diameter to the comparator 45, these producing the belt tension which is required in an individual case. FIG. 8 shows by way of a schematic block diagram how an automatic adjustment of the drive roller 16 can be undertaken with the aid of the tension devices according to FIGS. 1 to 7, and the quantity of yarn passed to the circular knitting machine by means of the delivery roller 18 can be controlled. In this case identical parts are provided with the same reference numbers throughout. Otherwise, in FIG. 8 only one delivery roller 18 is shown, which is driven similarly to FIGS. 1 to 7 by the drive belt 17 here shown only partly in broken lines, and delivers the yarn 6 (see also FIG. 1) to the circular knitting machine. Here the drive roller 16 is designed similarly for example to the German Utility Model 2 030 333, which is hereby incorporated into the subject-matter of the present disclosure by making reference there to in order to avoid repetitions, and accordingly, provided with an adjusting device 53 in the form of an electric motor, particularly a servo or stepping motor, which acts via a toothed gearing 54 on an actuator 55 in the form of a disc and provided with toothing on the circumference, which upon rotation of the motor in one or the other direction produces an alteration of the diameter of the peripheral section 16*a* guiding the drive belt 17. Moreover, there is shown in the area of the yarn 6 a measuring device 56 for detecting the quantity of yarn delivered by the delivery roller 18 to the circular knitting machine. Alternatively, the measuring device 56 might also be set up for determining the yarn tension. The measuring device 56 includes for example a measuring roller 57, around which the yarn is looped, and which has holes 59 spaced apart in the circumferential direction which can be scanned by an opto-electronic sensor 58. Alternatively the holes could be replaced by permanent magnets or other means, and the sensor could be designed inductively or otherwise. Yarn measuring devices and arrangements associated therewith for converting the delivered quantities of yarn into electrical measurement signals are generally known to the person skilled in the art and are explained for example in the publications DE-OS 21 27 953, DE-OS 24 36 401 or DE 38 27 453 C1, which are hereby incorporated into the subject-matter of the present disclosure by making reference thereto in order to avoid repetition.

The sensor 58 is connected to a circuit arrangement not shown in more detail and emits at its output an actual-value signal, which is characteristic for the quantity of yarn delivered at any moment. This preferably electrical signal is compared in a comparator 59 with a required-value signal, which is provided for example via a line 60 from a program control device 61 or a required-value emitter with an adjustable required value. The differential value determined by the comparator 59 is passed to a regulator 62, which generates an adjusting signal passed to the adjusting device 53, in such a way that the quantity of yarn delivered always corresponds to the required value predetermined by the program control device 61 or by the required-value emitter. This same program control device 61 can emit a required-value signal for the required-value emitter 46 (FIG. 6), via a line 63, in order according to the above description to alter the tension of the drive belt 17 in good time before or after an alteration predetermined by the program control device 61 of the required value passed to the comparator 59 and a consequent alteration in the diameter of the drive roller 16. Thus there results, as is the case with FIGS. 2 and 3, the advantage that an alteration of the quantity of yarn to be delivered and/or of the belt tension can be carried out simply and in a user-friendly manner from a central operating position or the like.

Determination of the diameter of the drive roller 16 necessary for a required quantity of yarn can be effected by reference to a table or by means of the formula $$d=L/(i\times\pi)$$

wherein d is the diameter of the peripheral section 16*a* of the drive roller 16, L is the quantity of yarn to be delivered in yarn length/revolution of the needle cylinder 3, and i is the transmission predetermined by the gearwheels 11 and 14 in FIG. 1 between the needle cylinder 3 and the drive roller 16. A condition in this respect is that the diameter of the peripheral section of the delivery roller 18 delivering the yarn 6 corresponds to the diameter of the peripheral section of the delivery roller 18 driven by the drive belt 17. If this is not so, the diameter of the peripheral section of the delivery roller 18 delivering the yarn is also included in the calculation. The value determined in this way for the diameter of the drive roller 16 can firstly be set, using the invention, for example manually via the program control device 61 (FIG. 8). Then this value can be monitored and kept constant by means of a regulating device according to FIG. 8.

The adjustment path necessary for displacement of the guide member 20 arises for example on the other hand from the formula $$1=(u1-u2)/4$$

wherein 1 is the displacement path and u1, u2 are the diameters of the peripheral section 16*a* before and after an alteration in diameter, a condition being that the guide member 20 is substantially looped around by the drive belt 17 over a peripheral section of 180°.

The invention is not restricted to the embodiments described, which can be modified in many ways. For example, the drive belt 17 can also be in the form in particular of a toothed belt, which co-operates with corresponding toothings of the various rollers or wheels. The term "drive belt" is thus intended to serve as a general title for all possible drive members. Furthermore, in the embodiment in FIGS. 2 and 3 the tension spring 21 could be omitted, if a certain minimum tension is not necessary or is produced in another way. Moreover it would be possible to use the tension spring 21 to generate a greater belt tension intended for normal operation of the delivery roller 18, and to use the tensioning unit 22 in order to generate a smaller belt tension intended for alteration of the diameter of the peripheral section 16*a*. For this purpose it would merely be necessary to produce the smaller belt tension in that a pressure medium is supplied to the cylinder 24 via the connection opening 30, in order in this way to extend the piston rod 26 and to entirely or partly remove the force of the tension spring 21. Furthermore, the means for setting the diameter of the peripheral section 16*a*, given only by way of example, could be replaced by other means. The same applies to the means proposed for alteration in the belt tension, which are only to be interpreted as examples, intended to simplify understanding of the invention. Above all it is possible to include the belt tension device according to FIGS. 2 and 3 similarly to FIGS. 4 and 5 in an enclosed regulating circuit, so that regulation is then effected at least partly with hydraulic or pneumatic means instead of by electrical means. Furthermore, the various measuring, control and regulating devices can be produced by modern micro-electronics, or with the aid of components controlled by micro-computers or the like. Finally it is self-evident that the features according to the invention can also be used in combinations different from those illustrated and described.

It will be understood that each of the elements described above, or two or more together, may also find a useful application in other types of constructions differing from the types described above.

While the invention h as been illustrated and described as embodied in a yarn delivery device on a textile machine, it is not intended to be limited to the details shown, since various modifications and structural changes may be made without departing in any way from the spirit of th e present invention.

Without further analysis, the foregoing will so fully reveal the gist of the present invention that others can, by appliying current knowledge, readily adapt it for various supplications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A yarn delivery device for a textile machine, comprising at least one yarn delivery roller; and a drive device for driving said delivery roller, said drive device including a drive belt, a drive roller with a peripheral section alterable in a diameter and at least in part looped around by said drive belt, and tensioning means with a guide member acting on said drive belt, said tensioning means including automatically controllable means for automatically bringing said guide member at least into a larger belt tension condition for a normal operation of said delivery roller and into a smaller belt tension condition if an alteration of the diameter of said peripheral section of said drive roller is desired.

2. A yarn delivery device as defined in claim 1, wherein said controllable means include an actuator connected to said guide member.

3. A yarn delivery device as defined in claim 1, wherein said actuator includes a cylinder-piston arrangement for displacing said guide member.

4. A yarn delivery device as defined in claim 2, wherein said tensioning means include a tension spring maintaining a pre-selected minimum belt tension.

5. A yarn delivery device as defined in claim 4, wherein said tension spring is connected parallel to said actuator with said guide member.

6. A yarn delivery device as defined in claim 5, wherein said tension spring is formed so as to substantially establish said smaller belt tension, while said tensioning means being formed to substantially establish said larger belt tension.

7. A yarn delivery device as defined in claim 2, wherein said actuator includes a tension unit, and a motor for moving said tension unit.

8. A yarn delivery device as defined in claim 1, wherein said guide member is a guide roller which is at least partially looped around by said drive belt.

9. A yarn delivery device as defined in claim 1; and further comprising a switch member associated with said tensioning means for switching over from said larger to said smaller belt tension and vice versa.

10. A yarn delivery device as defined in claim 9, wherein said switch member is an electrical switch.

11. A yarn delivery device as defined in claim 1, wherein said drive roller has a controllable setting device for altering the diameter of said peripheral section.

12. A yarn delivery device as defined in claim 11, wherein said setting device is an electric motor.

13. A yarn delivery device as defined in claim 1; and further comprising an automatically operating measuring device for measuring a quantity of yarn delivered by said delivery roller to the textile machine.

14. A yarn delivery device as defined in claim 1; and further comprising a regulating device for regulating a quantity of yarn delivered by said delivery roller to the textile machine.

15. A yarn delivery device as defined in claim 14, wherein said regulating device includes a comparator which has a respective input connected to a required-value emitter and an input connected to a measuring device as an actual-value emitter for the quantity of yarn, and an output connected to a regulator for a setting device for emitting a control signal dependent on a difference between required and actual values for the quantity.

16. A yarn delivery device as defined in claim 15, wherein said required-value emitter is formed as a part of a program control device of the textile machine and is settable to different required values.

17. A yarn delivery device as defined in claim 16, wherein said controllable means include an actuator connectable with the program control device to reduce or enlarge a belt tension before or after an alteration in the diameter of said peripheral section of said drive roller.

* * * * *